US008814112B2

(12) United States Patent
Thompson

(10) Patent No.: US 8,814,112 B2
(45) Date of Patent: Aug. 26, 2014

(54) ARTICLE SUPPORT DEVICE COMPRISING A ROTATABLE CONNECTION

(75) Inventor: Craig D. Thompson, Inver Grove Heights, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 348 days.

(21) Appl. No.: 12/972,686

(22) Filed: Dec. 20, 2010

(65) Prior Publication Data

US 2012/0153102 A1 Jun. 21, 2012

(51) Int. Cl.
*A47G 1/17* (2006.01)

(52) U.S. Cl.
CPC ..... *A47G 1/175* (2013.01)
USPC ..... 248/205.3; 248/683; 248/290.1; 248/225.21; 248/294.1; 248/307

(58) Field of Classification Search
CPC ..... E04G 7/16; A47G 1/175; A47G 1/20; A47G 1/202
USPC ..... 248/687, 691, 222.52, 222.51, 288.11, 248/290.1, 292.14, 294.1, 304, 299.1, 248/205.3, 225.21, 227.1, 307, 274.1, 248/279.1, 296.1, 222.12, 291.1, 289.11, 248/349.1, 220.22, 341, 58, 113, 309.2, 248/415, 131, 417, 418, 130, 916; 16/303, 16/330, 374, 375, 377, 376, 251; 403/348, 403/353, 92, 93; 224/547, 555, 901
See application file for complete search history.

(56) References Cited

U.S. PATENT DOCUMENTS

| | | | | | |
|---|---|---|---|---|---|
| 386,749 | A | * | 7/1888 | Johnson | 248/222.52 |
| 802,705 | A | * | 10/1905 | Parker | 248/292.13 |
| 4,024,312 | A | | 5/1977 | Korpman | |
| 4,094,490 | A | * | 6/1978 | Einhorn | 248/489 |
| 4,124,189 | A | * | 11/1978 | Einhorn | 248/489 |
| 5,507,464 | A | | 4/1996 | Hamerski | |
| 5,516,581 | A | | 5/1996 | Kreckel | |
| 5,895,022 | A | * | 4/1999 | Kim | 248/398 |
| 5,967,474 | A | * | 10/1999 | doCanto et al. | 248/205.3 |
| 6,082,686 | A | | 7/2000 | Schumann | |
| 6,106,937 | A | | 8/2000 | Hamerski | |
| 6,131,864 | A | | 10/2000 | Schumann | |
| 6,136,397 | A | | 10/2000 | Luhmann | |
| 6,187,404 | B1 | | 2/2001 | Schumann | |
| 6,536,371 | B2 | * | 3/2003 | Brazell | 116/309 |

(Continued)

FOREIGN PATENT DOCUMENTS

| | | |
|---|---|---|
| KR | 2010-0000002 | 1/2010 |
| WO | WO 95/06691 | 3/1995 |

OTHER PUBLICATIONS

International Search Report, PCT/US2011064810, mailed Nov. 7, 2012, 3 pages.

*Primary Examiner* — Kimberly Wood
(74) *Attorney, Agent, or Firm* — Kenneth B. Wood

(57) ABSTRACT

Herein is disclosed an article support device capable of being attached to a mounting surface using a stretch-releasable adhesive tape, the device comprising a base and a support body that is rotatably and non-detachably connected to the base, wherein the support body is rotatable relative to the base, between a first position in which the base and the stretch-releasable adhesive tape are hidden, and at least one second position in which at least a portion of a pull tab of the stretch-releasable adhesive tape is visible.

27 Claims, 7 Drawing Sheets

(56) References Cited

U.S. PATENT DOCUMENTS

| | | | | |
|---|---|---|---|---|
| 6,536,723 | B1 * | 3/2003 | Nakatani | 248/163.1 |
| 6,676,093 | B2 * | 1/2004 | Franck et al. | 248/205.3 |
| 7,178,770 | B2 | 2/2007 | Ryu | |
| 2003/0047654 | A1 * | 3/2003 | Johansson et al. | 248/205.3 |
| 2007/0102601 | A1 | 5/2007 | Thompson | |
| 2009/0020672 | A1 * | 1/2009 | Lai et al. | 248/274.1 |
| 2009/0242712 | A1 | 10/2009 | Thompson | |
| 2010/0123063 | A1 * | 5/2010 | Bauchet et al. | 248/274.1 |

* cited by examiner

ARTICLE SUPPORT DEVICE COMPRISING A ROTATABLE CONNECTION

BACKGROUND

Article support devices having hooks, clips, hangers, and various other types of article support members are widely used for mounting utensils, decorations, tools and various other articles onto a mounting surface (e.g., of a wall). In recent years, such article support devices have been used with stretch-releasable adhesive tape in order to facilitate attachment and detachment of the device to and from the mounting surface.

An article support device using a stretch-releasable adhesive tape often comprises a base comprising a planar surface configured to be attached to the stretch-releasable adhesive tape, in combination with a support body that comprises an article support member and that is removably attachable to the base, so that, when it is desired to remove the device from a mounting surface, the body can be detached from the base so as to access and activate the stretch-releasable adhesive.

SUMMARY

Herein is disclosed an article support device capable of being attached to a mounting surface using a stretch-releasable adhesive tape, the device comprising a base and a support body that is rotatably and non-detachably connected to the base, wherein the support body is rotatable relative to the base, between a first position in which the base and the stretch-releasable adhesive tape are hidden, and at least one second position in which at least a portion of a pull tab of the stretch-releasable adhesive tape is visible.

Thus in one aspect, herein is disclosed an article support device capable of being mounted onto a mounting surface using a stretch-releasable adhesive tape, comprising: a base comprising first and second major sides, the first major side comprising a first major surface that is configured to be attached to a stretch-releasable adhesive tape; and, a support body comprising first and second major sides and that is rotatably and non-detachably connected to the second major side of the base; wherein the support body is rotatable relative to the base, between a first position in which the base and the stretch-releasable adhesive tape are hidden, and at least one second position in which at least a portion of a pull tab of the stretch-releasable adhesive tape is visible.

Thus in another aspect, herein is disclosed a method of detaching an article support device from a mounting surface, the article support device comprising a support body and the method comprising: manually rotating the entirety of the support body relative to a base to which the support body is rotatably and non-detachably connected, from a first position to a second position, wherein when the support body is rotated to the second position at least a graspable portion of a pull tab of a stretch-releasable adhesive tape that bonds the base to the mounting surface and that was hidden by the support body when the support body was in the first position is thereby exposed; and, while the support body is in the second position, grasping and pulling on the pull tab to stretch and release the stretch-release adhesive at least from the mounting surface, thereby detaching the article support device from the mounting surface.

These and other aspects of the invention will be apparent from the detailed description below. In no event, however, should the above summaries be construed as limitations on the claimed subject matter, which subject matter is defined solely by the attached claims, as may be amended during prosecution.

Like reference numbers in the various figures indicate like elements. Some elements may be present in identical or equivalent multiples; in such cases only one or more representative elements may be designated by a reference number but it will be understood that such reference numbers apply to all such identical elements. Unless otherwise indicated, all figures and drawings in this document are not to scale and are chosen for the purpose of illustrating different embodiments of the invention. In particular the dimensions of the various components are depicted in illustrative terms only, and no relationship between the dimensions of the various components should be inferred from the drawings, unless so indicated. Although terms such as "top", bottom", "upper", lower", "under", "over", "front", "back", "outward", "inward", "up" and "down", and "first" and "second" may be used in this disclosure, it should be understood that those terms are used in their relative sense only unless otherwise noted. In particular, in some embodiments certain components may be present in interchangeable and/or identical multiples (e.g., pairs). For these components, the designation of "first" and "second" may apply to the order of use, as noted herein (with it being irrelevant as to which one of the components is selected to be used first). All uses of terms such as vertically and/or upwards are with respect to the Earth's gravity.

DETAILED DESCRIPTION

Figure 1:
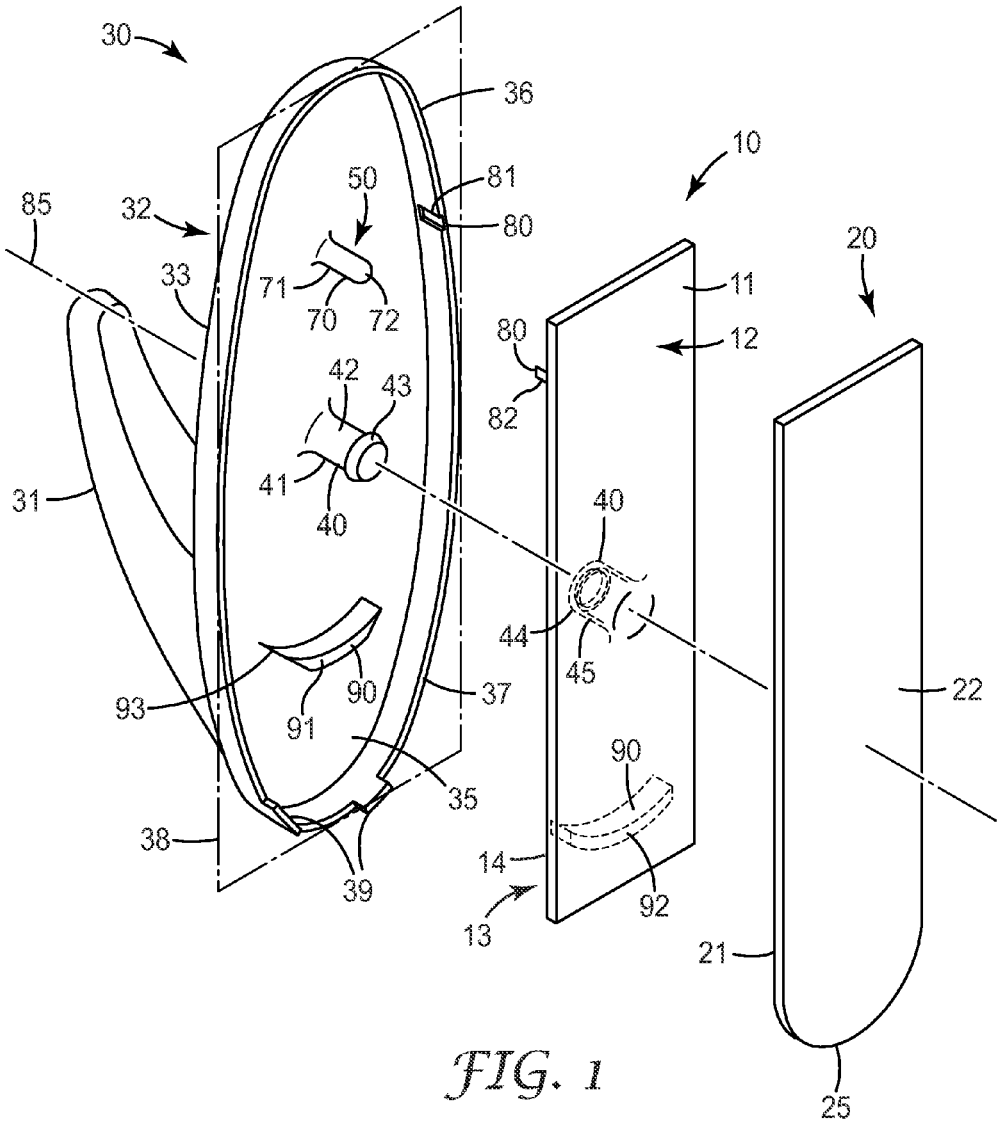
FIG. 1 is a rear/side perspective exploded view of an exemplary article support device.
Figure 2:
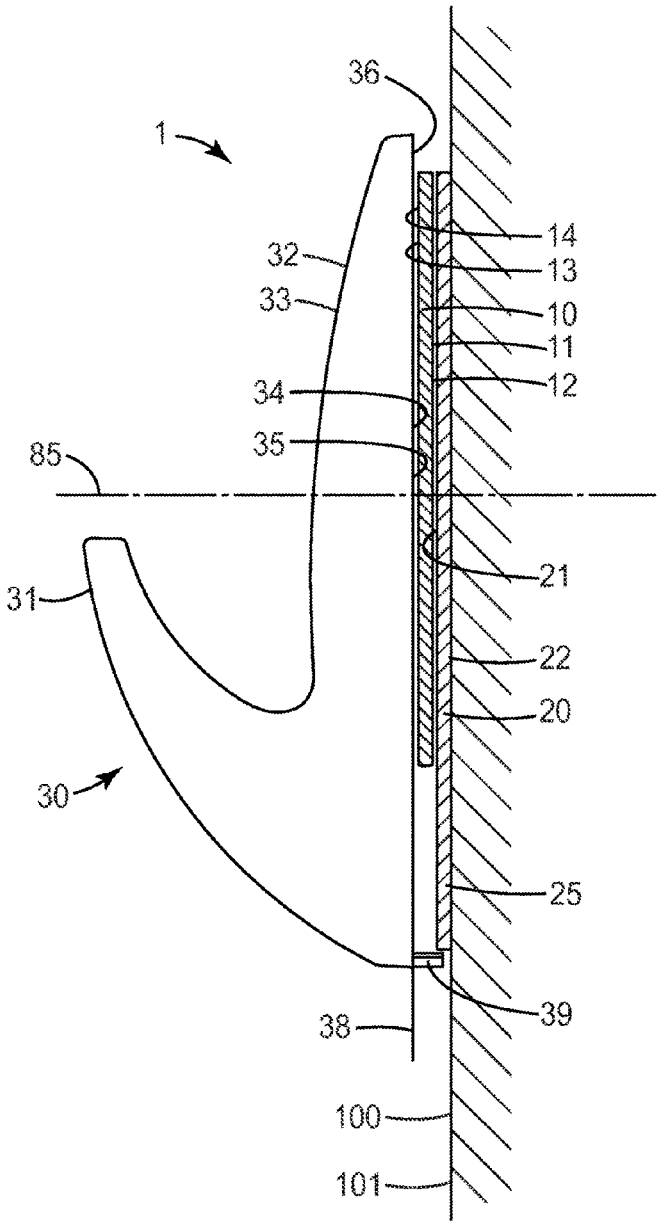
FIG. 2 is a side view of an exemplary article support device mounted to a mounting surface.

Shown in FIG. 1 is a rear/side perspective exploded view of an exemplary article support device 1. Shown in FIG. 2 is a side view of an exemplary article support device 1, mounted to a mounting surface 101 of wall 100 (with the term "wall" used to broadly encompass any partition, structure, item, etc., onto which it is desired to mount device 1). Device 1 comprises base 10 and support body 30, which are rotatably and non-detachably connected to each other as described in further detail herein. Base 10 comprises first major side 11 comprising (e.g., generally planar) first major surface 12 that is configured to be attached to first major adhesive surface 21 of stretch-releasable (double-faced) adhesive tape 20. First major surface 12 of base 10 may, but does not necessarily have to, occupy the entirety of first side 11 of base 10. Second major adhesive surface 22 of adhesive tape 20 may be adhesively attached to mounting surface 101 of wall 100. Adhesive tape 20 may be attached to first major surface 12 of base 10 so that a pull tab 25 of adhesive tape 20 extends beyond a terminal end of base 10 (e.g., along a direction generally aligned with a long axis of adhesive tape 20) so that pull tab 25 can be grasped and pulled when it is desired to activate the stretch-releasing properties of adhesive tape 20, as shown in exemplary manner in FIG. 2. That is, at least a portion of pull tab 25 typically will not be in overlapping relation with (i.e., will not be in face-to-face adjacency to) any portion of base 10. Often, base 10 and adhesive tape 20 may each comprise a long axis, which are generally aligned with each other when base 10 and adhesive tape 20 are attached to each other, as shown in exemplary manner in FIG. 1.

Base 10 comprises a second major side 13 comprising second major surface 14 and comprising a rotatable and non-detachable connection to support body 30. Support body 30 comprises a first, outward facing major side 32 comprising first major surface 33, and a second, base-facing major side 34 comprising second major surface 35 and comprising a rotatable and non-detachable connection to base 10. As used here and elsewhere herein, the term outward-facing with respect to support body 30 means in a direction generally opposite base 10 (and wall 100, when device 1 is mounted to mounting surface 101 of wall 100). First major side 32 of support body 30 comprises at least one article support member 31. Article support member 31 may be e.g. a hook as shown in exemplary manner in various Figs. of this disclosure. However, article support member 31 is not limited, and can be any suitable member that can be used, directly or indirectly, to support an article. Member 31 may directly support an article, and so in various embodiments may comprise any suitable hook, knob, hanger, protrusion, rod, clip, clamp, and the like, from which any article (e.g., a picture, towel, clock, etc., can be hung or otherwise supported). Or, member 31 may support an accessory which itself may support an article (e.g., by way of the article being placed into the accessory, being attached to the accessory, etc.). Thus, in such embodiments, article support member 31 may comprise any suitable coupling, connection, clamp, etc., that may be suitable for supporting an accessory such as a basket, tray, dish, rack, shelf, bracket, clip, etc., which accessory may then support any desired article.

In various embodiments, article support member (e.g., hook) 31 may be integrally formed with (e.g. by being molded with) the other portions of support body 30. Multiple article support members, which may be the same or different from each other, may be used.

Support body 30 and base 10 are rotatably and non-detachably connected to each other. By non-detachably connected is meant that support body 30 and base 10, once connected to each other, are not intended to be detached from each other in ordinary use of device 1. Article support devices comprising pieces that are designed to be completely separated from each other in course of demounting the article support device from a mounting surface by definition do not include a non-detachable connection. It will be appreciated that such a non-detachable connection can be established when device 1 is produced (e.g., at the factory) or can be established by a user prior to initial mounting of device 1. That is, base 10 and support body 30 may be supplied to a user in a non-connected condition, with the user then non-detachably connecting base 10 and support body 30 to each other (e.g., by snapping them together so as to form a rotatable, non-detachable connection). In some embodiments, the non-detachable connection may be configured so that support body 30 and base 10, once attached to each other, cannot be detached from each other without damaging or breaking at least a portion of support body 30 and/or base 10.

By rotatable connection (and rotatably connected, etc.) is meant that support body 30 and base 10 share a common axis of rotation such that the entirety of support body 30 can be rotated with respect to base 10, the common axis of rotation being generally normal to first surface 12 of base 10 (and to mounting surface 101, when device 1 is mounted onto surface 101) so that upon rotation of support body 30 relative to base 10 every point on support body 30 sweeps out a planar circular pathway that is generally parallel to surface 12 of base 10 (and to surface 101, if present). By rotatable connection (and rotatably connected, etc.) is further meant that support body 30 and base 10 are arranged so that no moving of support body 30 relative to base 10, in any direction other than the above-described rotating, is required or allowed prior to the rotating. Examples of apparatus which permit and/or require moving a support body relative to a base in one or more directions other than rotating the support body relative to a base, prior to the rotating of the support body, can be found e.g. in U.S. Pat. No. 6,131,864 to Schumann, which shows in FIGS. 3*a*-3*d* an apparatus in which a support body is moved upward relative to a base, and then outward from the base, prior to being rotated. Such apparatus do not fall with the present definition of a rotatable connection.

Figure 3:
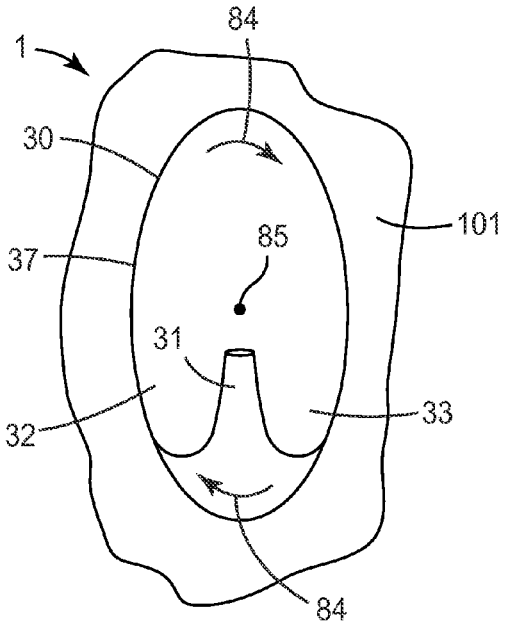
FIG. 3 is a front view of an exemplary article support device, with the support body of the article support device in a first position.
Figure 4:
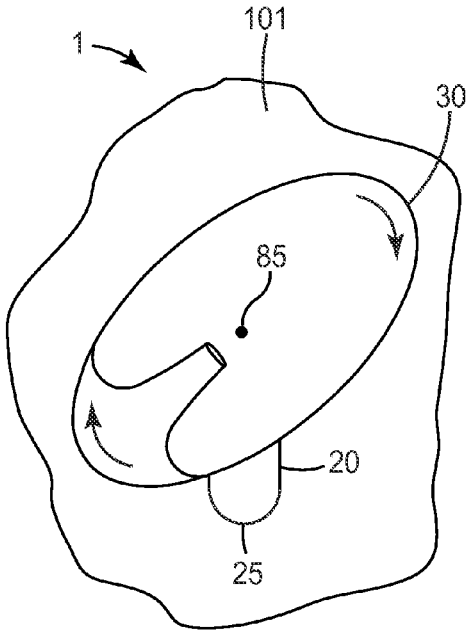
FIG. 4 is a front view of the article support device of FIG. 3, with the support body rotated away from the first position so that a portion of the pull tab of the article support device is visible.
Figure 5:
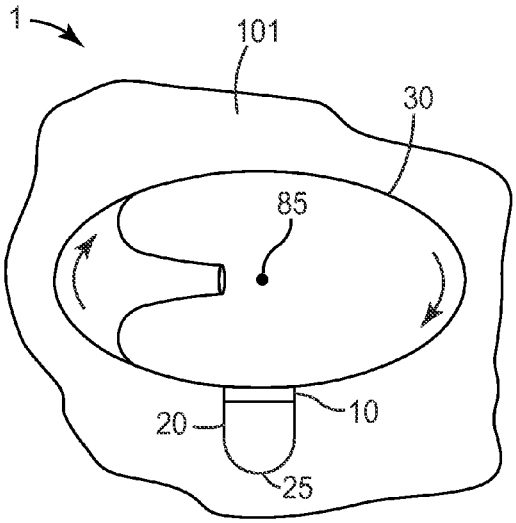
FIG. 5 is a front view of the article support device of FIG. 3, with the support body rotated to a greater extent than in FIG. 4, so that the pull tab of the article support device, and a portion of the base of the article support device, is visible.

Use of a rotatable connection between support body 30 and base 10 allows device 1 to be configured and used as illustrated in an exemplary manner in FIGS. 3-5. FIG. 3 shows a front view of an exemplary article support device 1 mounted to a mounting surface 101. Support body 30, and base 10 (not visible in FIG. 1 or 2), share common axis of rotation 85, which is generally normal to surface 101. In FIG. 3, support body 30 is positioned at a first (rotational) position (relative to base 10 and adhesive tape 20) in which base 10 and adhesive tape 20 are hidden. In this context, hidden means that base 10 and adhesive tape 20 are not visible to an observer positioned outward along the axis of rotation; that is, they are obscured by support body 30. Support body 30 thus may comprise perimeter 36 that circumferentially bounds (surrounds) base 10 and adhesive tape 20 (including pull tab 25 thereof). It may be convenient that (e.g. when article support member 31 comprises a hook) when support body 30 is in the first position, the terminal end of the hook is positioned so as to protrude generally vertically upward, as shown in the exemplary embodiment of FIG. 3. In some embodiments support body 30 may comprise a long axis; if so, it may be convenient that when support body 30 is in the first position, the long axis of support body 30 is generally aligned with a long axis of base 10, and/or is aligned vertically upward/downward. However, it will be appreciated that support body 30 may not necessarily comprise a long axis (e.g., it may be generally circular rather than being elongated as shown in FIG. 3). In such cases, support body 30 can still be placed in a first position relative to base 10 and adhesive tape 20, in which base 10 and adhesive tape 20 are hidden. In ordinary use of device 1, support body 30 may typically be in the first position after mounting of device 1 to mounting surface 101 and during the time when articles are supported by device 1.

When it is desired to demount (detach) device 1 from mounting surface 101, support body 30 may be rotated (e.g., manually, by a user) away from the first position, to a second position which allows pull tab 25 of adhesive tape 20 to be grasped and pulled so as to activate the stretch-releasing properties of adhesive tape 20. As such, a second position is defined herein as one in which at least a portion of pull tab 25 is no longer hidden. Conveniently, the second position will allow a sufficient portion of pull tab 25 to be accessed so as to facilitate the above-described grasping and pulling of pull tab 25. One such exemplary second position is shown in FIG. 4. In this exemplary second position, a portion of pull tab 25 is no longer hidden. Another exemplary second position is shown in FIG. 5; in this second position, the rotation is sufficient, and the design of support body 30 and base 10 are such, that when support body 30 is placed in the second position, the entirety of pull tab 25, and/or a portion of base 10, are now no longer hidden. In summary, the rotating of support body 30 from the first position to the second position provides that a portion of support body 30 that was in overlapping relation with pull tab 25 when support body was in the first position, is no longer in overlapping relation with at least a portion of pull tab 25 when support body 30 is in the second position, so that pull tab 25 is no longer hidden and can now be grasped and pulled. Those of ordinary skill will recognize that any suitable second position can be used as long as it permits the grasping/pulling process described herein.

In some embodiments, support body 30 may comprise an elongated shape with a long dimension (along a long axis) and a short dimension (e.g., that is oriented generally transversely to the long dimension). The long dimension of support body 30 may be chosen to be sufficiently long to extend beyond the terminal ends of a long dimension of base 10 and of adhesive tape 20 (e.g., as shown in FIG. 2). The short dimension may be chosen to be sufficiently short so that, upon rotation of support body 30 to the second position, at least a portion of pull tab 25 is suitably exposed as described above. In other embodiments, support body 30 may not comprise a long dimension (e.g., may comprise a generally circular perimeter). In such cases, support body 30 may comprise at least one peripheral opening (e.g., a notch that interrupts the generally circular perimeter) that is configured so that when support body 30 is rotated to the second position at least a portion of the pull tab is visible and accessible through the notch.

As mentioned, support body 30 may be rotated manually to the second position. In some embodiments, support body 30 may be rotatable in both a clockwise direction (when viewed from an outward perspective along the axis of rotation), as shown in FIGS. 2-5, and in a counterclockwise direction. In such embodiments, at least two second positions may exist, at least one in a clockwise direction, and at least one in a counterclockwise direction. In other embodiments, support body 30 may be rotatable only in one direction, clockwise or counterclockwise (with clockwise rotation being illustrated in FIGS. 3-5). In such case, one or more indicia 84 (e.g., arrows) may be provided on (outward-facing, visible) first major surface 33 of first major side 32 of support body 30, indicating the direction of rotation of support body 30 from position 1 to position 2.

It will be appreciated that numerous advantages and/or enhancements may result from the use of device 1, e.g. in comparison to article support devices in which it is intended that pieces of the device be separated from each other in ordinary use of the device. For example, use of device 1 may be simpler, and may not result in support body and bases becoming separated from each other and mislaid or lost.

In some embodiments, first (outward-facing, visible) major surface 33 of first major side 32 of support body 30 advantageously may not comprise any visible abutment lines. Visible abutment lines of a support body are defined herein as visible lines resulting from the abutment (junction) of surfaces of portions of support body 30 that are movable and/or separable from each other. Exemplary abutment lines may be seen, for example, in FIG. 1 of U.S. Pat. No. 7,178,770 (at the abutment between movable piece 30 and the rest of body 14) and in FIG. 9*a* of the same U.S. patent (at the abutment between movable piece 116 and the rest of body 102). It will be appreciated that designs such as those disclosed herein, in which the entirety of support body 30 may be moved (rotated) with respect to base 10, without being detached therefrom, may allow first major surface 33 of support body 30 to avoid visible abutment lines, which may be perceived as unsightly by some users.

Figure 6:
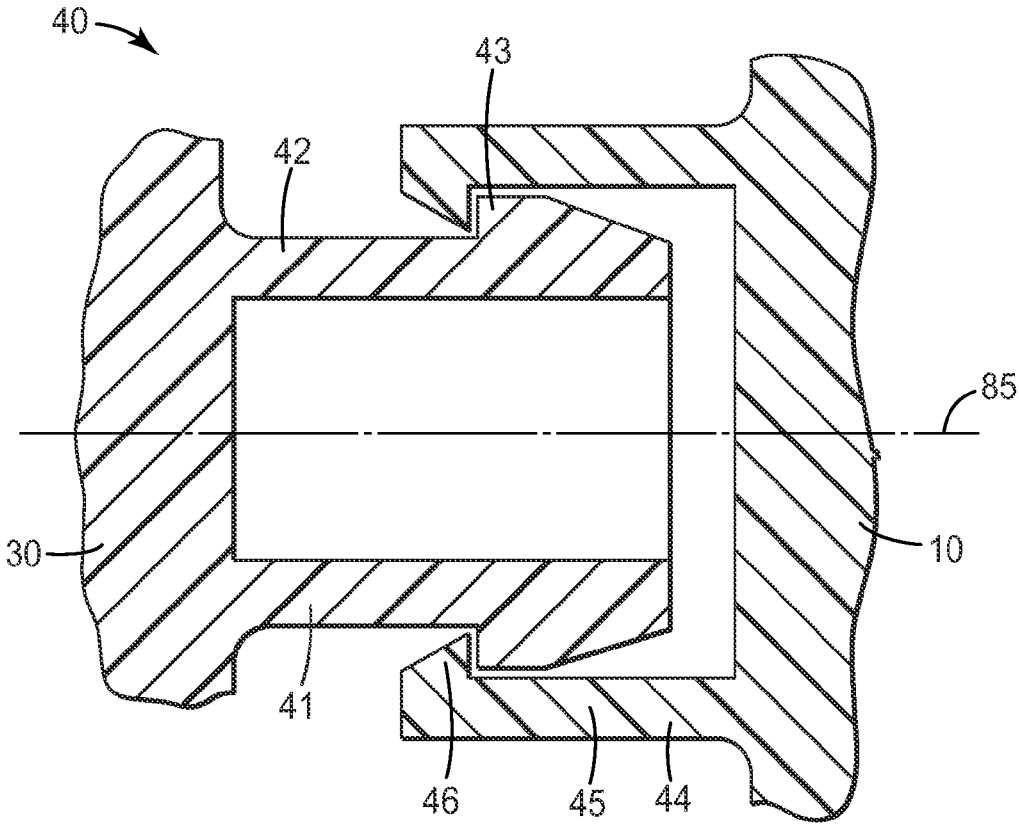
FIG. 6 is a side cross-sectional view of an exemplary rotatable, non-detachable connection between a support body and a base.

The rotatable, non-detachable connection between base 10 and support body 30 may be provided by any suitable mechanism. One such type of mechanism is shown in exemplary embodiment in FIGS. 1 and 6. In the illustrated embodiment, base 10 and support body 30 collectively comprise at least one set 40 (e.g., pair) of rotatable, non-detachable complementary connecting structures. The term complementary is used broadly, to signify that complementary connecting structure 41 of support body 30, and complementary connecting structure 44 of base 10, which collectively comprise complementary connecting structures 40, are capable of connecting (e.g., mating) with each other so as to provide a rotatable, non-detachable connection. In the illustrated embodiment, complementary connecting structure 41 of support body 30 comprises cylindrical post 42 with radially-outwardly protruding, circumferentially-extending, barb (i.e., rim or flange) 43, and complementary connecting structure 44 of base 10 comprises cylindrical, radially-hollow post 45 with inwardly-protruding circumferentially-extending barb 46. Radially-hollow post 45 may be sized so as to receive at least the terminal portion of post 42, and each component may be configured so that barbs 43 and 46 interact to establish a non-detachable, rotatable connection between structures 41 and 44 and thus between support body 30 and base 10. While the exemplary illustration shows support body 30 comprising a post 42 with an outwardly-protruding barb, that is received into radially-hollow, cylindrical post 45 of base 10, it will be appreciated that this situation could be reversed.

The exemplary rotatable, non-detachable connection between support body 30 and base 10 may be established e.g. by snap-fitting complementary connecting structure 41 (e.g., post 42) of support body 30, and complementary connecting structure 44 (e.g., post 45) of base 10, to each other. Such snap-fitting may be done at the factory or by a user. While snap-fitted structures 41 and 44 have been described herein for convenience, it will be appreciated that any suitable method of providing a rotatable, non-detachable connection between base 10 and support body 30 may be used. The design and dimensions of complementary connecting structures 40 and various components thereof may be chosen so as to establish desired relationships between support body 30 and base 10 (e.g., the distance between second major surface 35 of support body 30 and second major surface 14 of base 10).

It will be appreciated that the rotatable, non-detachable connection, between support body 30 and base 10 is arranged so that movement of support body 30 relative to base 10, in any direction except the aforementioned rotating, is substantially prevented. That is, no such motion, except for such minor movements (e.g., of about 0.5 mm or less) as might occur in the process of overcoming the retaining force presented by the below-described detent structures, may be permitted.

In various embodiments, support body 30 and base 10 collectively comprise at least one first set (e.g., pair) 50 of complementary detent structures 50, defined herein as any set of complementary structures that collectively serve (e.g., by physically interfering with each other) to maintain support body 30 in the first position relative to base 10, until the application of sufficient, predetermined rotation force so as to move support body 30 away from the first position and toward the second position. The predetermined rotation force may be chosen to be sufficiently high to minimize the chances of accidental rotation occurring (e.g., upon the placing of an article in position to be supported by device 1), but may be chosen to be less than the shear force of the stretch-releasable adhesive tape used. Any suitable complementary detent structures can be used. In various exemplary embodiments, such complementary detent structures may comprise one or more male (protruding) structures of either support body 30 or of base 10, and one or more complementary female (receiving/receptacle) structures of either support body 30 or of base 10, the receiving structure(s) being configured to receive at least a portion of the protruding structure(s) and to retain this portion of the protruding structure in place until the application of the predetermined rotation force, at which time the predetermined rotation force will overcome the holding force of the complementary detent structures. The predetermined force required to overcome the holding force may be set by the particular design of the complementary detent structures.

Figure 7:
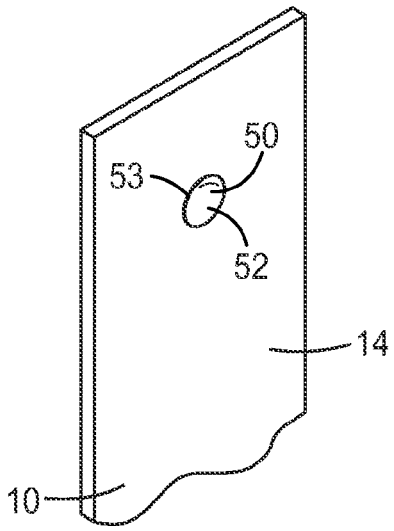
FIG. 7 is a front/side perspective view of an exemplary complementary detent structure of a base.
Figure 8:
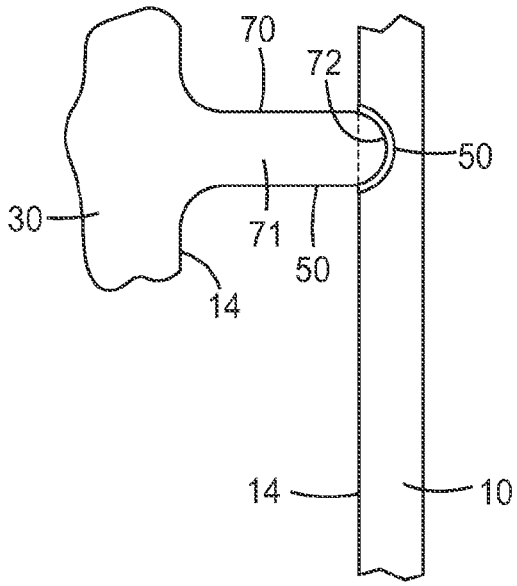
FIG. 8 is a side cross sectional view of an exemplary complementary detent structure of a support body, mated to the complementary detent structure of the base of FIG. 7.
Figure 9:
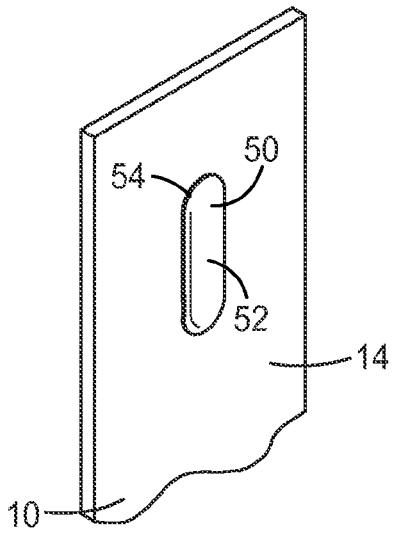
FIG. 9 is a front/side perspective view of another exemplary complementary detent structure of a base.
Figure 10:
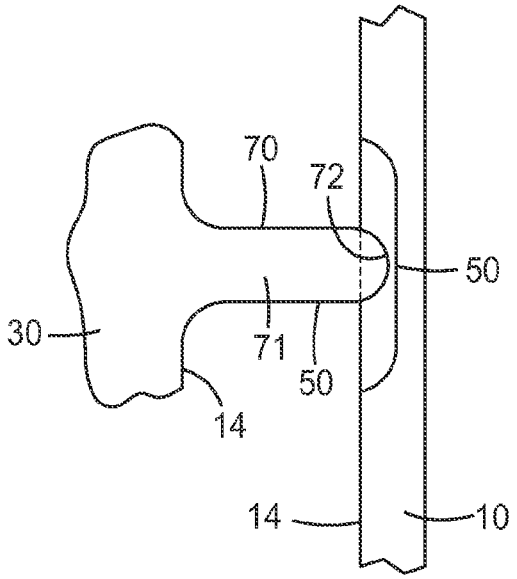
FIG. 10 is a side cross sectional view of an exemplary complementary detent structure of a support body, mated to the complementary detent structure of the base of FIG. 9.

Various exemplary sets of detent structures are shown in FIGS. 1 and 7-13. As shown in FIG. 1 and in further detail in FIGS. 8 and 10, support body 30 may comprise a first complementary detent structure 70 in the form of a protruding detent post 71 that protrudes from second major side 34 of support body 30 generally toward base 10 and that comprises terminal portion 72. Base 10 may comprise (as shown in FIGS. 7 and 9, not visible in FIG. 1) a first complementary detent structure 52 in the form of a recessed cavity (receptacle) which is arranged to receive at least a portion of terminal portion 72 of detent post 71. The recessed cavity may comprise a generally circular shape (as in the recessed cavity 53 of in FIG. 7); or may comprise an elongated notch 54 (as shown in FIG. 9) e.g. with the long axis of the notch being generally aligned perpendicular to the arcuate pathway followed by terminal portion of 72 of post 71 when support body 30 is rotated away from the first position relative to base 10. The use of an elongated notch 54 oriented in this manner may allow somewhat more flexibility in the placing of terminal portion 72 of post 71 within the notch, while still allowing the terminal portion of the post to be securely prevented from being dislodged from the notch along the rotation path of the post, until the predetermined force is applied.

Figure 11:
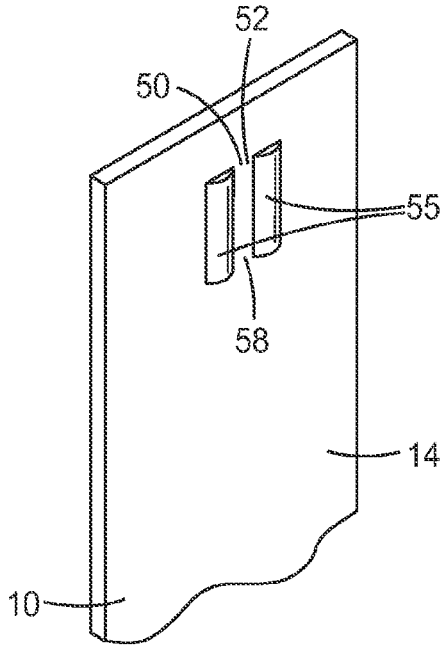
FIG. 11 is a front/side perspective view of another exemplary complementary detent structure of a base.

Another exemplary type of complementary detent structure is shown in FIG. 11. In such embodiments, protrusions (e.g., ridges) 55 are provided that protrude away from surface 14 (e.g., generally toward support body 30) so as to border and at least partially define notch 58 therebetween, into which terminal portion 72 of post 71 may be received and maintained until application of the predetermined rotation force. This design may advantageously provide that, once sufficient force is applied to motivate post 71 along its path of rotation past one of protruding ridges 55, terminal portion 72 of post 71 may avoid contact with surface 14 of base 10 as the rotation is continued, which may provide for ease of carrying out the desired rotation. Protrusions 55 may thus be positioned adjacent notch 58 (in opposite directions) along the arcuate path swept out by a terminal portion 72 of a post 71. In an exemplary variation of this approach, a recessed detent cavity (e.g., a generally circular cavity), rather than being a cavity recessed within a generally planar surface 14 as shown in exemplary manner in FIG. 7, could be defined by (i.e. bounded) by a generally circular protrusion (e.g. a doughnut-shaped encircling ring) that protrudes above surface 14. This may provide that, so that once sufficient force is applied to motivate a detent post along its path of rotation past the encircling protruding ring, a terminal portion of the post may avoid contact with surface 14 of base 10 as the rotation is continued, in similar manner as achieved in the embodiment of FIG. 11. All such variations are encompassed within the disclosures herein.

Figure 12:
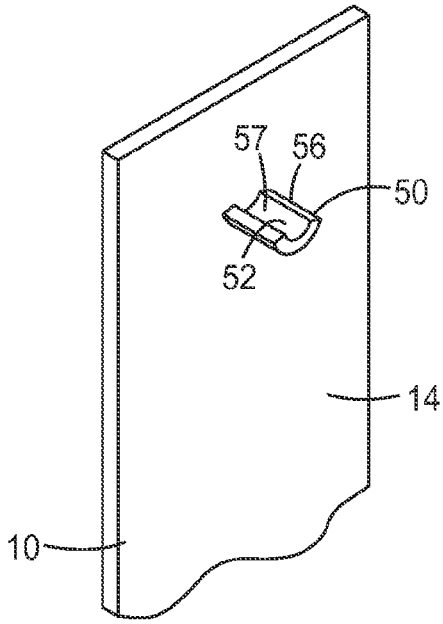
FIG. 12 is a front/side perspective view of another exemplary complementary detent structure of a base.

Still another type of complementary detent structure is shown in FIG. 12. In such embodiments, abutment (e.g., post) 56 is provided which protrudes away from surface 14 of base 10 (e.g., generally toward support body 30), and which comprises recess (e.g., notch) 57 which is arranged to receive at least a terminal portion 72 of post 71. If recess 57 is arranged to face generally vertically upwards (as shown in FIG. 12), the application of a load onto support body 30 (for example, by the supporting of an article by device 1) may more securely hold the complementary detent structures 50 together (e.g., more securely hold at least terminal portion 72 of post 71 within recess 57) and thus more securely hold support body 30 in the first position.

It will be appreciated that any suitable first set 50 of complementary detent structures may be used in device 1. In particular, although for convenience the exemplary embodiments of FIGS. 1-11 have been described generally in terms of support body 30 comprising a male (protruding) detent structure and base 10 comprising a female (recessed) detent structure, this could be reversed if desired. Moreover, although only a single first detent structure has been shown on base 10 and a single first detent structure has been shown on support body 30, any number of complementary detent structures (e.g., in pairs) can be used. Such a first detent structure or structures can be located at any suitable position on first major side 32 of support body 30 and second major side 13 of base 10. For example, while the detent structures in FIGS. 1 and 7-13 have been shown for convenience as being located generally vertically above the axis of rotation of support body 30, the detent structures could be located below the axis of rotation. (In such cases, the placing of a load onto article support member 31 of support body 30 may serve to hold the detent structures more firmly together). If desired, detent structures may be provided both above and below the axis of rotation. Support body 30 and base 10 can each comprise mixtures of one or more male first detent structures and one or more female first detent structures. In short, many configurations and combinations are possible, and are within the scope of the disclosures herein.

In some embodiments, the rotation of support body 30 away from the first position may be unlimited (e.g., such that article support member 31 may be positioned generally upside down from the position shown in FIG. 1, and/or such that support body 30 can freewheel around axis of rotation 85). In other embodiments, the rotation of support body 30 may be limited so that support body 30 may not be rotated past the designated second position. Such limitation of rotation may be achieved by any suitable set of complementary rotation-limiting structures 80, e.g. in which at least one structure 82 of base 10 physically interferes with at least one structure 81 of support body 30 to limit such rotation. Such a rotation-limiting structure 82 of base 10 may be e.g. a protruding structure as shown in the exemplary illustration of FIG. 1. Such a rotation-limiting structure 81 of support body 30 may, e.g. in the case in which support body 30 comprises a perimeter 36 with a flange 37, be provided by a portion of flange 37 at location 81 which contacts protruding structure 82 of base 10 when support body 30 reaches the second position and prevents further rotation of support body 30 relative to base 10.

Such complementary rotation-limiting structures, while preventing further rotation of support body 30 past the second position, may not necessarily maintain support body 30 at the second position (e.g., prevent rotation of support body 30 back toward the first position). In some instances, it may be desired to prevent such backwards rotation of support body 30 until a desired time, in which case the complementary rotation-limiting structures 80 of support body 30 and base 10 may take the form of a set of second detent structures that serve to maintain support body 30 in the second position until the application of a second, predetermined force to rotationally urge support body 30 away from the second position and back toward the first position. (As used herein, the term first detent structures refer to those detent structures serving to maintain support body 30 in the first position; the term second detent structures refer to those detent structures serving to maintain support body 30 in the second position). It will be appreciated that the second predetermined force required to move support body 30 away from the second position and toward the first position, may be different from, e.g. less than, the aforementioned predetermined force required to move support body 30 away from the first position and toward the second position. The first and second predetermined forces may be set by the design of the first and second set of complementary detent structures.

Any suitable second detent structures of base 10 and of support body 30 may be used, including any of those described previously as useful as first detent structures. In a specific exemplary embodiment shown in FIG. 1, a notch 81 can be provided at the proper location of perimeter flange 37 of support body 30, which, upon rotation of support body 30 to the second position, is arranged to receive and retain at least a portion of protruding structure 82 of base 10, until the application of the second predetermined force.

It will be appreciated that any number of rotation-limiting structures (which may be second detent structures), of any type, may be provided on base 10 and support body 30. In various embodiments, the rotation of support body 30 away from the first position may be limited to about 90 degrees clockwise or counterclockwise, about 70 degrees clockwise or counterclockwise, about 50 degrees clockwise or counterclockwise, or about 30 degrees clockwise or counterclockwise.

In some embodiments, it may be desired to provide one or more force-transferring structures 90 that may transfer at least some force between support body 30 and base 10 (e.g., which support body 30 is under load, such as when it is supporting an article). Such a force-transferring structure or structures may reduce the force that may otherwise be transferred from rotatable and non-detachable connecting structure 41 of support body 30, to rotatable and non-detachable connecting structure 44 of base 10. That is, force-transferring structures 90 may reduce the load placed on the rotatable and non-detachable connection between support body 30 and base 10, when support body 30 is in the first position and is under load. Any suitable force-transferring structures can be used. In the exemplary embodiment of FIG. 1, support body 30 comprises force-transferring member (e.g., rib) 91 which, when support body 30 is in position 1, may abut a similarly shaped member (e.g., rib) 92 of base 10. Member 91 of support base 30 and member 92 of base 10 may be configured so that member 91 resides closely vertically above (e.g., within 1 mm, 0.5 mm, or 0.2 mm) member 92, so that when support body 30 is placed under load, member 91 contacts member 92 (i.e., a lower surface of member 91 contacts an upper surface of member 92) so as to transfer force thereto. Members 91 and 92 may be arcuate and may be generally congruent in shape to each other (as shown in FIG. 1), so that they can be brought into close vertical abutment with each other but can also allow the herein-described rotation to be easily performed. If desired, the adjacent, oppositely-facing surfaces of arcuately-terminal ends 93 of members 91 and 92 may be chamfered or otherwise shaped to ensure that, upon support body 30 being rotated from the second position back to the first position, members 91 and 92 easily traverse back into their closely-abutting relationship without terminal ends 93 of the respective members physically interfering with each other. Exemplary shaped (e.g. chamfered) arcuately-terminal ends 93 of member 91 of support body 30 are visible in FIG. 1.

It will be appreciated that any suitable force-transferring structures, of any suitable design, can be used. For example, either of support body 30 or base 10 might comprise an arcuate recessed slot arranged to receive an arcuate protruding member (e.g., rib), an arcuate slot in between two arcuate protruding ribs, etc., to similar effect. Any number of such force-transferring structures may be used. It will also be appreciated that the above-described complementary detent features may also serve to at least an extent as force-transferring structures.

It will be appreciated that, in order for the herein-described rotation to be performed, no part of support body 30 (specifically, perimeter 36 and flange 37 thereof, if present) should unacceptably contact any part of either base 10 or of adhesive tape 20 in such a way as would prevent the rotation from being achieved. It may thus be provided that support body 30 is outwardly offset from base 10, from adhesive tape 20, and/or from surface 101, at least when support body 30 is in the second position. Such an outward offset may be conveniently described with reference to the position of imaginary plane 38 (as shown in FIGS. 1 and 2) that is established by at least a coplanar major portion of perimeter 36 that is proximate surface 101 (e.g., a terminal portion of perimeter flange 37 that is proximate surface 101). In some embodiments, support body 30 is outwardly offset such that when device 1 is mounted onto a mounting surface 101, imaginary plane 38 is outwardly spaced from surface 101 (in a direction generally normal to surface 101) by a distance that is greater than the combined thickness of base 10 and adhesive tape 20 (such an outward offset is shown in illustrative embodiment in FIG. 2), at least when support body 30 is in the second position.

In some embodiments, the outward offset may be constant, meaning that it does not change with the rotated position (around its permitted arc of rotation) of support body 30 relative to base 10. In such embodiments, the outward offset of support body 30 is substantially the same whether support body 30 is in the first position or the second position. In other embodiments, the outward offset may be variable, with device 1 configured so that as support body 30 is rotated from the first position toward the second position, the offset increases, e.g. such that when support body 30 is at the second position, the offset is a distance that is greater than the combined thickness of base 10 and adhesive tape 20. This may be achieved e.g. by configuring rotatable non-detachable connecting structures 40 to comprise a helically-threaded connection.

In some embodiments, no part of support body 30, e.g. of perimeter 36 of support body 30, extends from second major side 34 of support body 30 toward surface 101 beyond imaginary plane 38 of support body 30 (e.g., regardless of the rotated position of support body 30). In other embodiments, it may be desired to provide one or more force-transmitting structures 39 that may extend beyond imaginary plane 38 so as to transmit at least some force from support body 30 to surface 101 of wall 100, at least when device 1 is under load. (For convenience, structures that relay force (load) between support body 30 and wall 100 are referred to herein as force-transmitting structures; structures that relay force (load) between support body 30 and base 10 are referred to herein as force-transferring structures). It may be particularly advantageous to provide at least one such force-transmitting structure proximate the vertically downward (lowermost) end of support body 30. Such force-transmitting structures 39 may comprise e.g. minor portions of perimeter flange 37, as shown in exemplary manner in FIGS. 1 and 2. Such structures 39 may extend from support body 30 toward wall 100 so that, at least when support body 30 is in the first position, the terminal end of structure(s) 39 is in close proximity to (e.g., is less than about 0.5 mm from) surface 101 of wall 100. This may provide that, when support body 30 is placed under load, any slight deflection of support body 30 may result in the terminal end of structure(s) 39 coming into contact with surface 101 and thus transmitting at least some force into wall 100. Provision of one or more such force-transmitting structures may at least slightly reduce the moment load carried by the rotatable and non-detachable connection when device 1 is under load. If such force-transmitting structures 39 are provided, they may be positioned and configured so that they do not contact base 10 or adhesive tape 20 during rotation of support body 30 between its first and second positions. For example, structures 39 may be provided as shown in FIGS. 1 and 2, so that they are positioned radially outward (with respect to the axis of rotation of support body 30) beyond the terminal end of base 10 and the terminal end of pull tab 25 of adhesive tape 20, so that structures 39 are not in overlapping relation with any portion of adhesive tape 20 or base 10, while support body 30 is at its first position, at its second position, and all points therebetween.

Figure 13:
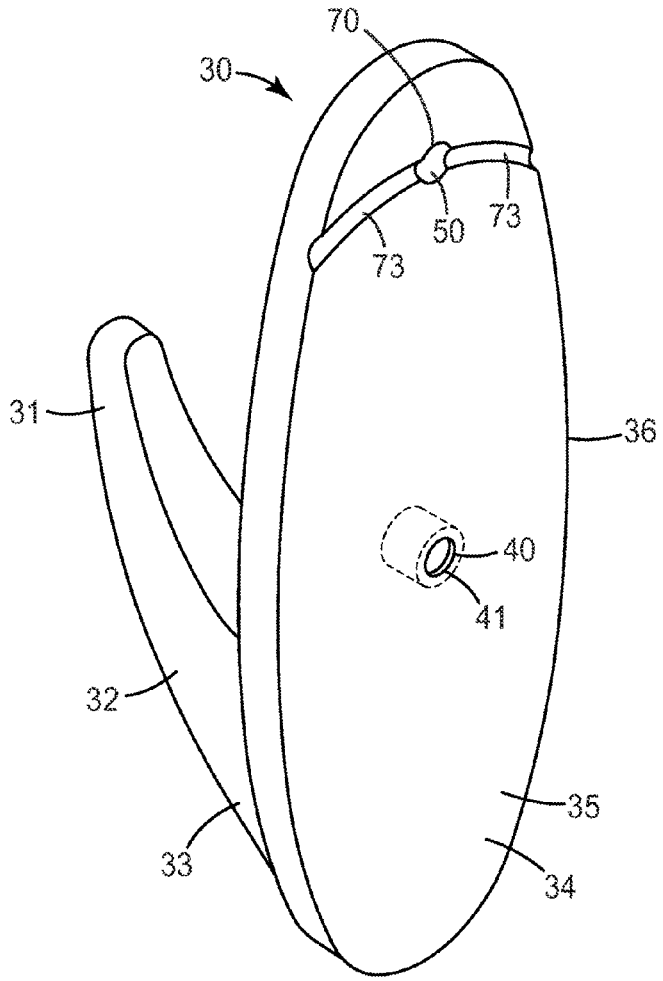
FIG. 13 is a rear/side perspective view of an exemplary support body with a generally solid rear surface.

Those of ordinary skill will appreciate that many variations on the above structural features are possible, as long as the functionalities disclosed herein are provided. For example, in FIG. 13 is shown an exemplary support body 30 comprising at least some features that vary somewhat from those discussed previously. For example, support body 30, rather than being a partly hollow structure in which second major side 34 of support body 30 is open-ended (i.e., of the type shown in FIG. 1) may instead be of the general type shown in FIG. 13, in which support body 30 may be solid, or at least may comprise a generally planar second major surface 35 that is substantially coincident with the aforementioned imaginary plane 38 defined by perimeter 36 of support body 30. In further example, support body 30 may comprise a female complementary connecting structure 41 (e.g., a cavity comprising an inwardly-protruding circumferentially-extending barb) that is configured to be mated with a male complementary connecting structure 44 of base 10. In still further example, support body 30 may comprise a female (recessed) first complementary detent structure 70 that is configured to receive at least a terminal portion of a male (protruding) first complementary detent structure of base 10. In the case in which at least a portion of second major surface 35 of support body 30 is substantially coincident with imaginary plane 38 (e.g., as shown in FIG. 13), it may be convenient to provide an arcuate channel 73 that may provide a pathway for a terminal portion of a protruding first complementary detent structure of base 10, as the detent structure is rotated away from female first complementary detent structure 70.

Other structural features may be included as desired to provide particular functionalities. For example, support body 30 and/or base 10 may comprise one or more reinforcing (support) ribs that enhance the strength and/or resistance to deflection or deformation, of the support body and/or the base. The long axis of such ribs may, e.g., be generally vertically aligned and/or may be generally aligned with a long axis of the support body or base. Such ribs may be particularly useful in the case of a support body 30 of the general type shown in FIG. 1 (with an at least partly hollow, open-ended structure) as opposed to a generally solid support body of the general type shown in FIG. 13. Such ribs or any other suitable type of reinforcing structure may be provided as an adjunct to (e.g., physically contacting and integrally molded along with) any of the various structural features disclosed herein (e.g., the rotatable and non-detachable connecting structures, complementary detent structures, rotation-limiting structures, force-transferring structures, and/or force-transmitting structures).

In some embodiments, support body 30 may comprise an integrally molded body (e.g., formed of an injection-moldable organic polymeric material) that does not include, or have attached to it, any other components (excepting the herein-described rotatable and non-detachable connection to base 10) that are not integrally molded with support body 30. In some particular embodiments, article support device 1 does not comprise any kind of spring structure or mechanism. Support body 30 and/or base 10 may conveniently be molded of materials with relatively low coefficients of friction in order to enhance the ability of various components (e.g. of rotatable, non-detachable complementary connecting structures 40) to be moved relative to each other while touching each other As mentioned, support body 30 and base 10 may be preattached to each other at the factory, or may be shipped to a user to be attached to each other. Similarly, adhesive tape 20 may be preattached to base 10 (i.e., with first surface 21 of adhesive tape 20 adhesively attached to first surface 12 of first side 11 of base 10); or, adhesive tape 20 may be supplied separately. Even if a piece of adhesive tape 20 is preattached to base 10, it may be convenient to provide additional pieces of adhesive tape 20, since device 1 may be mounted onto a wall surface, demounted, and mounted again (i.e., with a fresh piece of adhesive tape 20).

In use of device 1, first surface 21 of adhesive tape 20 may be attached to first surface 12 of base 10, and (e.g., with support body 30 in the first position) second surface 22 of adhesive tape 20 may be attached to a desired location of surface 101 of wall 100. Conveniently, device 1 may be oriented such that (with support body 30 in the first position) a long axis of support body 30 and a long axis of base 10 are vertically co-aligned. Device 1 may be maintained in this position and configuration as long as desired, with one or more articles being supported by device 1 during this time. When it is desired to demount device 1 from wall 100, a user may apply sufficient rotational force to support body 30 to overcome the retaining force provided by the physical interference of the first complementary detent structures with each other, and thereby rotate support body 30 away from its first position and toward and into its second position. As mentioned previously, no moving of support body 30 in any direction other than rotating, will be required prior to the rotating. That is, the application of sufficient rotational force to overcome the retaining force of the complementary detent structures is the only action that is required to initiate the rotation. The user may then manually stop the rotation at a suitable second position; or the aforementioned rotation-limiting structures may serve to stop the rotation at the second position. The user may maintain support body 30 in its second position; or, if rotation-limiting structures are provided in the form of second complementary detent structures, support body 30 may remain at the second position without being held by the user. With support body 30 at the second position, pull tab 25 of adhesive tape 20 may be grasped and pulled so as to activate the stretch-releasing properties of adhesive tape 20. If and when it is desired to mount device 1 to a mounting surface 101 again, support body 30 may be returned to its first position (with force being applied to overcome the retaining force provided by the second complementary detent structures, if present), a fresh piece of adhesive tape 20 attached to first surface 12 of base 10, and device 1 mounted to a mounting surface 101 as previously described.

Adhesive tape 20 can comprise any suitable stretch-releasable tape that comprises pressure-sensitive adhesive functionality on oppositely-facing first major surface 21 and second major surface 22. Adhesive tape 20 is configured such that first major surface 21 can be adhered to first surface 12 of base 10, such that second major surface 22 can be adhered to a suitable surface 101 of a wall 100, and such that one or both of the adhesive surfaces can be detached from the surface to which it is adhesively bonded, by the activation of a stretch-releasing property of the adhesive tape. Adhesive tape 20 can comprise any suitable stretch-releasable (double-faced) adhesive that may be available in the form of a sheet, tape, roll good, etc., from which a discrete piece can be obtained that is suitable for being contacted with and bonded to first surface 12 of base 10. A suitable stretch-releasing adhesive tape can comprise an elastic backing, or a highly extensible and substantially inelastic backing, with a pressure-sensitive adhesive disposed (e.g. coated) thereupon. Or, the tape can be formed of a solid, elastic pressure sensitive adhesive. Thus, in this context, the term "tape" encompasses products that comprise a unitary, integral, or solid construction of adhesive (in addition to products that comprise a backing with separate layers of adhesive residing thereupon). Suitable exemplary stretch-releasing tapes are described e.g. in U.S. Pat. No. 4,024,312 to Korpman; U.S. Pat. No. 5,516,581 to Kreckel et al.; and PCT International Publication No. WO 95/06691 to Bries et al. Such stretch-release adhesives can range, for example, from about 0.2 mm in thickness to about 2 mm in thickness. In particular, such stretch-release adhesives are often about 1 mm in thickness. Adhesive tape 20 may comprise a pull tab 25 (e.g., an end of the tape that does not comprise adhesive surfaces) that may be grasped by a user and pulled so as to activate the stretch-release properties of the adhesive.

List of Exemplary Embodiments

Embodiment 1. An article support device capable of being mounted onto a mounting surface using a stretch-releasable adhesive tape, comprising: a base comprising first and second major sides, the first major side comprising a first major surface that is configured to be attached to a stretch-releasable adhesive tape; and, a support body comprising first and second major sides and that is rotatably and non-detachably connected to the second major side of the base; wherein the support body is rotatable relative to the base, between a first position in which the base and the stretch-releasable adhesive tape are hidden, and at least one second position in which at least a portion of a pull tab of the stretch-releasable adhesive tape is visible.

Embodiment 2. The device of embodiment 1 wherein the support body comprises a first major side comprising an article support member, and a second major side comprising a rotatable and non-detachable connection to the second major side of the base.

Embodiment 3. The device of any of embodiments 1-2 wherein when the device is mounted onto a mounting surface and at least when the support body is in the second position, the support body is outwardly offset from the mounting surface a distance that is greater than a combined thickness of the base and the adhesive tape.

Embodiment 4. The device of any of embodiments 2-3 wherein the article support member comprises an outwardly-protruding hook.

Embodiment 5. The device of any of embodiments 2-4 wherein the first major side of the support body does not comprise any visible abutment lines.

Embodiment 6. The device of any of embodiments 1-5 wherein the support body comprises a perimeter that circumferentially bounds the base when the support body is in the first position.

Embodiment 7. The device of any of embodiments 1-6 wherein the support body has an elongated axis and the base has an elongated axis, and wherein when the support body is in the first position the elongated axis of the support body is aligned with the elongated axis of the base.

Embodiment 8. The device of any of embodiments 1-7 wherein the support body comprises at least one first support body complementary detent structure and the base comprises at least one first base complementary detent structure, the first complementary detent structures combining to allow the support body to be maintained at the first position with respect to the base, and further combining to allow, upon the application of a predetermined amount of rotation force to the support body in a direction away from the first position and toward the second position, the support body to be rotated away from the first position and toward the second position.

Embodiment 9. The device of embodiment 8 wherein the first complementary detent structures collectively comprise at least one protruding member that protrudes from the second major side of the base or the second major side of the support body, and at least one receptacle in the second major side of the base or the second major side of the support body, that is configured to receive at least a terminal portion of the protruding member when the support body is in the first position.

Embodiment 10. The device of embodiment 9 wherein the device is configured so that the terminal portion of the protruding member sweeps out an arcuate path upon rotation of the support body away from the first position and toward the second position, and wherein the at least one receptacle is bordered by, and at least partially defined by, at least one first protrusion that is adjacent the receptacle along the arcuate path of the terminal portion of the protruding member in a first direction, and at least one second protrusion that is adjacent the receptacle along the arcuate path of the terminal portion of the protruding member in a second direction generally opposite to the first direction.

Embodiment 11. The device of any of embodiments 1-10 wherein the device is configured so that the support body is rotatable away from the first position, in a clockwise and a counterclockwise direction.

Embodiment 12. The device of embodiment 11 wherein the second position is located at a rotation angle away from the first position of from about 30 degrees to about 80 degrees, clockwise or counterclockwise.

Embodiment 13. The device of any of embodiments 1-10 wherein the support body is rotatable relative to the base in one direction only, and wherein a first major surface of the first major side of the support body comprises at least one visible indicia indicative of the direction of rotation from the first position to the second position.

Embodiment 14. The device of any of embodiments 1-13 wherein the second major side of the base and the second major side of the support body each comprise at least one complementary rotation-limiting structure, the rotation-limiting structure of the support body interacting with the rotation-limiting structure of the base to physically limit the rotation of the support body relative to the base so that the support body cannot be rotated beyond the second position.

Embodiment 15. The device of embodiment 14 wherein the rotation-limiting structures of the support body and base comprise, respectively, a second support body complementary detent structure and a second base complementary detent structure, the second complementary detent structures combining to allow the support body to be maintained at the second position, and further combining to allow, upon the application of a predetermined rotation force to the support body in a direction toward the first position, the support body to be rotated away from the second position and toward the first position.

Embodiment 16. The device of any of embodiments 1-15 wherein the support body and the base each comprise a molded body comprised of an injection moldable organic polymeric material and wherein the support body and the base are connected to each other by a snap-fitted connection that serves as a rotatable, non-detachable connection between the support body and the base.

Embodiment 17. The device of any of embodiments 1-16 further comprising a stretch-releasable adhesive tape comprising a portion that is adhesively bonded to the first major surface of the first major side of the base and further comprising a pull tab that is not in overlapping relation with, and is not adhesively bonded to, the first surface of the first major side of the base.

Embodiment 18. The device of any of embodiments 1-17 wherein the support body comprises at least one support body force-transferring structure that is generally arcuately shaped and wherein the base comprises at least one base force-transferring structure that is generally arcuately shaped and that is generally congruent with the shape of the force-transferring structure of the support body, wherein the force-transferring structures are configured so that, when the support body is in the first position and the device is under load, at least a portion of the force-transferring structure of the support body is in contact with at least a portion of the force-transferring structure of the base.

Embodiment 19. The device of any of embodiments 1-18 wherein the support body comprises at least one force-transmitting structure that is not in overlapping relation with any portion of the base or the adhesive tape when the support body is in the first position or in the second position and that is configured so that, when the support body is in the first position and the device is under load, at least a terminal portion of the force-transmitting structure of the support body is in contact with at least a portion of the mounting surface.

Embodiment 20. A method of detaching an article support device from a mounting surface, the article support device comprising a support body and the method comprising: manually rotating the entirety of the support body relative to a base to which the support body is rotatably and non-detachably connected, from a first position to a second position, wherein when the support body is rotated to the second position at least a graspable portion of a pull tab of a stretch-releasable adhesive tape that bonds the base to the mounting surface and that was hidden by the support body when the support body was in the first position is thereby exposed; and, while the support body is in the second position, grasping and pulling on the pull tab to stretch and release the stretch-release adhesive at least from the mounting surface, thereby detaching the article support device from the mounting surface.

Embodiment 21. The method of embodiment 20 wherein the rotating of the support body from the first position to the second position causes the entirety of the support body to move outward away from the base and from the mounting surface in a direction generally perpendicular to the mounting surface.

Embodiment 22. The method of any of embodiments 20-21 wherein when the support body is in the first position, a portion of the second major side of the support body is in overlapping relation with the pull tab of the adhesive tape and is not in overlapping relation with any portion of the base, and wherein upon rotating the support body to the second position, the portion of the support body that was previously in overlapping relation with the pull tab is no longer in overlapping relation with the pull tab and the pull tab is visible.

Embodiment 23. The method of any of embodiments 20-22 wherein the support body comprises a perimeter and no portion of the perimeter contacts any portion of the base during rotation of the support body from the first position to the second position.

Embodiment 24. The method of any of embodiments 20-23, wherein the method uses an article support device comprising any of embodiments 1-19.

It will be apparent to those skilled in the art that the specific exemplary structures, features, details, configurations, etc., that are disclosed herein can be modified and/or combined in numerous embodiments. All such variations and combinations are contemplated by the inventor as being within the bounds of the conceived invention. Thus, the scope of the present invention should not be limited to the specific illustrative structures described herein, but rather extends at least to the structures described by the language of the claims, and the equivalents of those structures. To the extent that there is a conflict or discrepancy between this specification and the disclosure in any document incorporated by reference herein, this specification will control.

What is claimed is:

1. An article support device capable of being mounted onto a mounting surface using a stretch-releasable adhesive tape, comprising:

a base comprising first and second major sides, the first major side comprising a first major surface that is configured to be attached to a stretch-releasable adhesive tape; and, a support body comprising first and second major sides and that is rotatably and non-detachably connected to the second major side of the base;

wherein the support body is rotatable relative to the base, between a first position in which the base and the stretch-releasable adhesive tape are hidden, and at least one second position in which at least a portion of a pull tab of the stretch-releasable adhesive tape is visible, wherein no moving of the support body relative to the base, in any direction other than the rotating, is required or allowed prior to rotating the support body, wherein the support body and the base share a common axis of rotation that is at least generally normal to the first major surface of the base, and wherein the support body comprises at least one support body force-transferring structure that is generally arcuately shaped and wherein the base comprises at least one base force-transferring structure that is generally arcuately shaped and that is generally congruent with the shape of the force-transferring structure of the support body, wherein the force-transferring structures are configured so that, when the support body is in the first position and the device is under load, at least a portion of the force-transferring structure of the support body is in contact with at least a portion of the force-transferring structure of the base.

2. The device of claim 1 wherein the support body comprises a first major side comprising an article support member, and a second major side comprising a rotatable and non-detachable connection to the second major side of the base.

3. The device of claim 2 wherein when the device is mounted onto a mounting surface and at least when the support body is in the second position, the support body is outwardly offset from the mounting surface a distance that is greater than a combined thickness of the base and the adhesive tape.

4. The device of claim 2 wherein the article support member comprises an outwardly-protruding hook.

5. The device of claim 2 wherein the first major side of the support body does not comprise any visible abutment lines.

6. The device of claim 1 wherein the support body comprises a perimeter that circumferentially bounds the base when the support body is in the first position.

7. The device of claim 1 wherein the support body has an elongated axis and the base has an elongated axis, and wherein when the support body is in the first position the elongated axis of the support body is aligned with the elongated axis of the base.

8. The device of claim 1 wherein the device is configured so that the support body is rotatable away from the first position, in a clockwise and a counterclockwise direction.

9. The device of claim 8 wherein the second position is located at a rotation angle away from the first position of from about 30 degrees to about 80 degrees, clockwise or counterclockwise.

10. The device of claim 1 wherein the support body and the base each comprise a molded body comprised of an injection moldable organic polymeric material and wherein the support body and the base are connected to each other by a snap-fitted connection that serves as a rotatable, non-detachable connection between the support body and the base.

11. The device of claim 1 further comprising a stretch-releasable adhesive tape comprising a portion that is adhesively bonded to the first major surface of the first major side of the base and further comprising a pull tab that is not in overlapping relation with, and is not adhesively bonded to, the first surface of the first major side of the base.

12. An article support device capable of being mounted onto a mounting surface using a stretch-releasable adhesive tape, comprising:

a base comprising first and second major sides, the first major side comprising a first major surface that is configured to be attached to a stretch-releasable adhesive tape; and, a support body comprising first and second major sides and that is rotatably and non-detachably connected to the second major side of the base;

wherein the support body is rotatable relative to the base, between a first position in which the base and the stretch-releasable adhesive tape are hidden, and at least one second position in which at least a portion of a pull tab of the stretch-releasable adhesive tape is visible, and wherein no moving of the support body relative to the base, in any direction other than the rotating, is required or allowed prior to rotating the support body, and wherein the support body and the base share a common axis of rotation that is at least generally normal to the first major surface of the base, and wherein the support body comprises at least one force-transmitting structure that is not in overlapping relation with any portion of the base or the adhesive tape when the support body is in the first position or in the second position and that is configured so that, when the support body is in the first position and the device is under load, at least a terminal portion of the force-transmitting structure of the support body is in contact with at least a portion of the mounting surface.

13. The device of claim 12 wherein the support body comprises a first major side comprising an article support member, and a second major side comprising a rotatable and non-detachable connection to the second major side of the base.

14. The device of claim 13 wherein the article support member comprises an outwardly-protruding hook.

15. The device of claim 13 wherein the first major side of the support body does not comprise any visible abutment lines.

16. The device of claim 12 wherein the support body has an elongated axis and the base has an elongated axis, and wherein when the support body is in the first position the elongated axis of the support body is aligned with the elongated axis of the base.

17. The device of claim 12 wherein the device is configured so that the support body is rotatable away from the first position, in a clockwise and a counterclockwise direction.

18. The device of claim 12 wherein the support body and the base each comprise a molded body comprised of an injection moldable organic polymeric material and wherein the support body and the base are connected to each other by a snap-fitted connection that serves as a rotatable, non-detachable connection between the support body and the base.

19. The device of claim 12 further comprising a stretch-releasable adhesive tape comprising a portion that is adhesively bonded to the first major surface of the first major side of the base and further comprising a pull tab that is not in overlapping relation with, and is not adhesively bonded to, the first surface of the first major side of the base.

20. An article support device capable of being mounted onto a mounting surface using a stretch-releasable adhesive tape, comprising:

a base comprising first and second major sides, the first major side comprising a first major surface that is configured to be attached to a stretch-releasable adhesive tape; and, a support body comprising first and second major sides and that is rotatably and non-detachably connected to the second major side of the base;

wherein the support body is rotatable relative to the base, between a first position in which the base and the stretch-releasable adhesive tape are hidden, and at least one second position in which at least a portion of a pull tab of the stretch-releasable adhesive tape is visible, wherein no moving of the support body relative to the base, in any direction other than the rotating, is required or allowed prior to rotating the support body, wherein the support body and the base share a common axis of rotation that is at least generally normal to the first major surface of the base, and wherein the second major side of the base and the second major side of the support body each comprise at least one complementary rotation-limiting structure, the rotation-limiting structure of the support body interacting with the rotation-limiting structure of the base to physically limit the rotation of the support body relative to the base so that the support body cannot be rotated beyond the second position, wherein the rotation-limiting structures of the support body and base comprise, respectively, a second support body complementary detent structure and a second base complementary detent structure, the second complementary detent structures combining to allow the support body to be maintained at the second position, and further combining to allow, upon the application of a predetermined rotation force to the support body in a direction toward the first position, the support body to be rotated away from the second position and toward the first position.

21. The device of claim 20 wherein the support body comprises a first major side comprising an article support member, and a second major side comprising a rotatable and non-detachable connection to the second major side of the base.

22. The device of claim 21 wherein the article support member comprises an outwardly-protruding hook.

23. The device of claim 21 wherein the first major side of the support body does not comprise any visible abutment lines.

24. The device of claim 20 wherein the support body has an elongated axis and the base has an elongated axis, and wherein when the support body is in the first position the elongated axis of the support body is aligned with the elongated axis of the base.

25. The device of claim 20 wherein the device is configured so that the support body is rotatable away from the first position, in a clockwise and a counterclockwise direction.

26. The device of claim 20 wherein the support body and the base each comprise a molded body comprised of an injection moldable organic polymeric material and wherein the support body and the base are connected to each other by a snap-fitted connection that serves as a rotatable, non-detachable connection between the support body and the base.

27. The device of claim 20 further comprising a stretch-releasable adhesive tape comprising a portion that is adhesively bonded to the first major surface of the first major side of the base and further comprising a pull tab that is not in overlapping relation with, and is not adhesively bonded to, the first surface of the first major side of the base.

* * * * *